United States Patent [19]

Hammer et al.

[11] Patent Number: 4,900,986

[45] Date of Patent: Feb. 13, 1990

[54] BALLAST CIRCUIT FOR STARTING FLUORESCENT LAMPS

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 240,904

[22] Filed: Sep. 6, 1988

[51] Int. Cl.[4] ..... H05B 41/14; H05B 41/36

[52] U.S. Cl. ..... 315/101; 315/97; 315/106; 315/DIG. 2

[58] Field of Search ..... 315/94, 97, 101, 102, 315/105, 106, 107, 207, 232, 241 R, 309, DIG. 2, DIG. 5

[56] References Cited

U.S. PATENT DOCUMENTS

| | | | |
|---|---|---|---|
| 3,626,243 | 12/1971 | Koyama et al. | 315/101 |
| 3,631,317 | 12/1971 | Miyajima | 315/94 |
| 3,644,780 | 2/1972 | Koyama et al. | 315/100 |
| 3,665,243 | 5/1972 | Kaneda et al. | 315/101 |
| 3,701,925 | 10/1972 | Nozawa et al. | 315/101 |
| 3,866,088 | 2/1975 | Kaneda et al. | 315/105 |
| 3,875,459 | 4/1975 | Remery et al. | 315/205 |
| 4,210,850 | 7/1980 | Britton | 315/290 |
| 4,238,708 | 12/1980 | Kaneda | 315/289 |
| 4,323,824 | 4/1982 | Roche et al. | 315/289 |
| 4,460,848 | 7/1984 | Fahnrich | 315/101 |
| 4,649,319 | 3/1987 | Shurgan | 315/99 |

*Primary Examiner*—David Mis

*Attorney, Agent, or Firm*—John P. McMahon; Stanley C. Corwin; Fred Jacob

[57] ABSTRACT

An improved ballast circuit for fluorescent lamps includes an electronic bilateral triggering device and a capacitor connected in series combination across the secondary winding output terminals of a ballasting transformer and in shunt with the fluorescent lamps. The triggering device and the capacitor operate to produce high frequency oscillations superimposed on the high AC voltage applied across the lamp cathodes to improve the capacitive coupling between the lamps and their mounting fixture during starting. The triggering device becomes nonconductive to effectively remove itself and the capacitor from the starting circuit while the lamps are lit.

16 Claims, 4 Drawing Sheets

BALLAST CIRCUIT FOR STARTING FLUORESCENT LAMPS

BACKGROUND OF THE INVENTION

The present invention relates to ballast circuits for starting gas discharge lamps, and, more particularly, to an improved rapid-start ballast circuit for a fluorescent lamp that produces high frequency oscillations superimposed on the AC voltage wave applied across the lamp for more efficient and reliable starting thereof.

A fluorescent lamp is a well known light source which typically consists of an elongate glass envelope having an interior wall coated with a suitable phosphor, such as calcium halophosphate, rare earth aluminate, zinc silicate or calcium tungsten, and having a cathode at each end of the envelope for application of an AC voltage across the lamp. The envelope also contains a quantity of an ionizable material such as mercury, and a low pressure of fill gas such as argon, krypton, neon or a mixture of these gases. The lamp is started by applying a large AC voltage supplied by a ballast circuit across the cathodes of the lamp to create a flow of electrons or an arc between the cathodes. The electron flow results in the ionization of the mercury atoms and the atoms of the fill gas which produces ultraviolet radiation. The ultraviolet radiation impinges upon the phosphor on the wall of the lamp which generates visible light in response thereto.

Creating the arc between the lamp cathodes and establishing ionization of the fill gas atoms with conventional ballast circuits can be a problem. Several cycles of the AC starting voltage and several starting attempts are often needed before the lamp lights, resulting in the familiar flickering of the lamp before it is fully illuminated. Starting aids are often employed to improve the capacitive coupling between the lamp and the mounting fixture to improve the starting efficiency and reliability. One technique is to reduce the spacing between the lamp and its mounting fixture, but this can reduce effective light output and cause undue heating of the fixture. Other starting aids include painting or otherwise affixing conductor strips on the lamp or providing an expensive tin oxide coating on the interior of the lamp to improve the capacitive coupling between the lamp and its mounting fixture.

It is accordingly an object of the present invention to provide an improved ballast circuit for a fluorescent lamp.

An additional object is to provide an improved ballast circuit of the above-character, which is capable of starting a fluorescent lamp in rapid-start fashion.

A further object is to provide a rapid-start ballast circuit of the above-character, wherein lamp starting is effected in an efficient and reliable manner without resort to special lamp starting aids.

Another object is to provide a ballast circuit of the above-character, which is simple in construction, inexpensive to manufacture, and reliable over a long service life.

Other objects of the invention will in part be obvious and in part appear hereinafter.

SUMMARY OF THE INVENTION

In accordance with the present invention, there is provided an improved ballast circuit for rapidly starting and powering a fluorescent lamp. The improved ballast circuit comprises a ballasting transformer for developing a high AC voltage across a pair of secondary winding output terminals respectively connected to the lamp cathodes and the series combination of an electronic bilateral triggering device and a capacitor connected across the secondary winding output terminals in shunt with the fluorescent lamp.

In accordance with the present invention, the electronic bilateral triggering device is of the type whose operating characteristics are such that when the rising portion of an AC voltage positive half cycle wave applied across the device exceeds its characteristic breakover voltage, breakover current flows through the device to charge the capacitor. The value of the capacitor is selected so as to limit the current flow through the device to a value less than the characteristic holding current value of the electronic bilateral triggering device, which, if exceeded, triggers the device to a low impedance state. It is found that, under these conditions, current flow through the device, oscillates between the breakover current value and the capacitor-limited current value at a frequency determined by the inductance of the ballasting transformer and the capacitance of the capacitor. These oscillations are effective in generating a burst of high frequency oscillations superimposed on the applied AC voltage wave as long as the device characteristic breakover voltage is exceeded. Similar, high frequency bursts are generated on each negative half cycle of the AC voltage wave. These high frequency bursts improve the capacitive coupling between the lamp and its mounting fixture, thereby facilitating lamp starting.

When the fluorescent lamp starts, it represents a low impedance path to current, thus holding the AC voltage across the bilateral triggering device-capacitor series combination well below the device breakover voltage. The device is maintained nonconductive to effectively remove itself and its series capacitor from the ballast circuit while the lamp is lighted.

DESCRIPTION OF THE DRAWINGS

Like reference numerals refer to corresponding parts throughout the several figures of the drawings.

DETAILED DESCRIPTION OF THE PREFERRED EMBODIMENT

Figure 1:
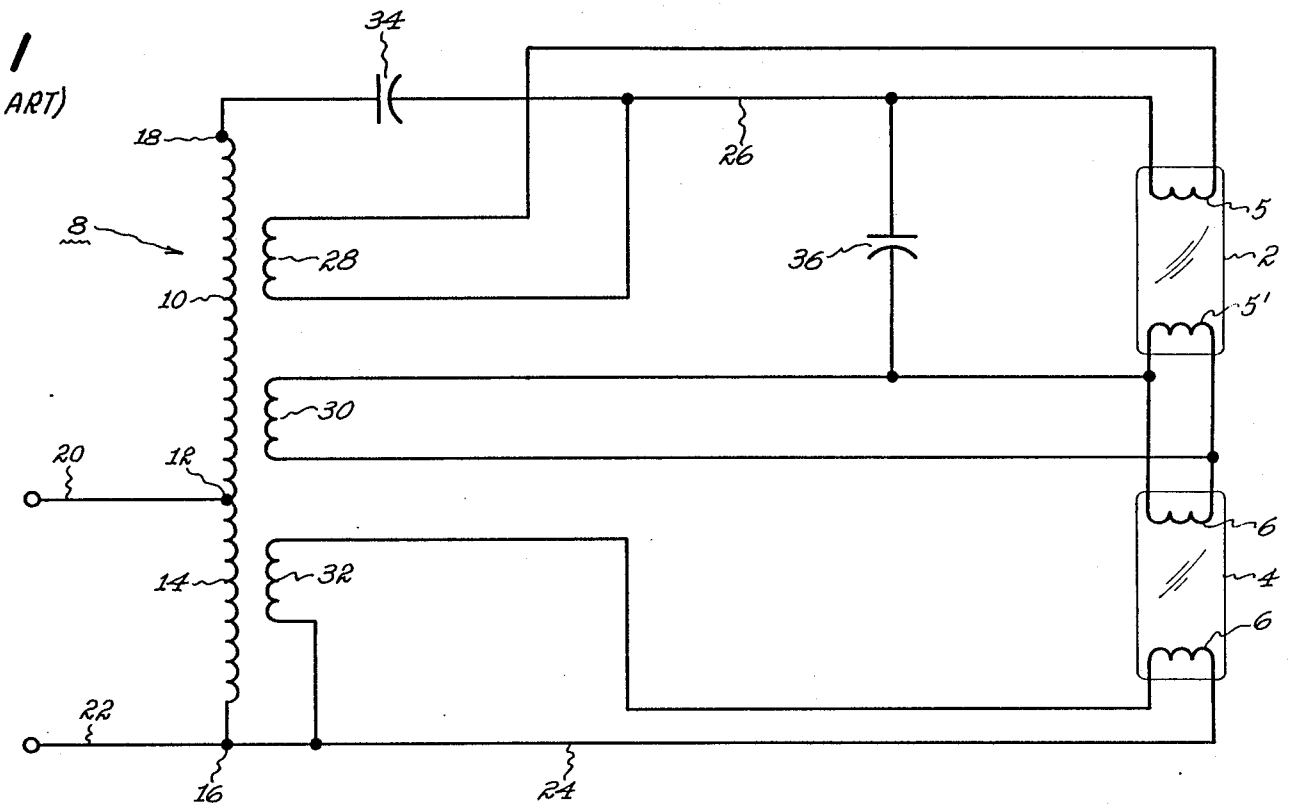
Fig. 1 (PRIOR ART)
FIG. 1 is a schematic diagram of a conventional ballast circuit.

Referring now in greater detail to the accompanying drawings and initially to FIG. 1, wherein there is illustrated a typical prior art ballast circuit for operating two fluorescent lamps 2, 4 connected in series. Each fluorescent lamp 2, 4 has a pair of cathodes 5,5' and 6,6', respectively, one at each of the opposite ends of the lamps. The lamps are connected in series by connecting the terminals of their respective cathodes 5', 6' together.

The ballast circuit includes a ballasting transformer, indicated generally at 8, having a secondary winding 10, which may be tapped, as indicated at 12, to provide a primary winding section 14 between the tap and a common transformer terminal 16. The primary winding section 14 has input terminals 20 and 22 respectively connected to tap 12 and transformer terminal 16 for the application of an AC voltage thereacross. The secondary winding 10 has a pair of output terminals 16, 18 which are connected by respective ballast circuit output leads 24, 26 to the end cathodes 5, 6 of the serially connected lamps 2, 4 for applying a high AC voltage thereacross.

The conventional ballast circuit shown in FIG. 1 also includes an arrangement for supplying heating current to the respective cathodes 5, 5' and 6, 6' of the lamps 2, 4 to prevent premature sputtering of electron emission material from the cathodes and thereby to prolong lamp life. The heating current arrangement includes three ballasting transformer tertiary windings 28, 30 and 32. Winding 30 is connected across the interconnected terminals of cathodes 5', 6', while windings 28, 32 are each respectively connected across the terminals of the two remaining end cathodes 5, 6 for supplying heating currents to each of the lamp cathodes.

Figure 4:
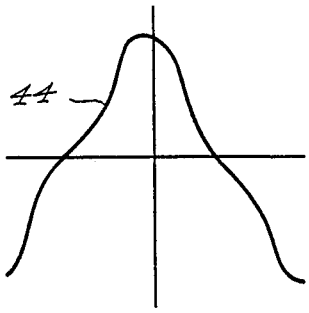
FIG. 4 is a graph of the typical applied open circuit voltage waveform generated by the conventional ballast circuit of FIG. 1.

A capacitor 34, which provides the main capacitive reactance as well as simultaneously providing power factor correction, is connected between secondary winding output terminal 18 and cathode 5 to counteract the inductive reactance of the ballasting transformer 8, and a starting capacitor 36 is connected across the upper lamp 2 to facilitate starting the lamps. The starting capacitor 36 causes a substantial portion of the secondary voltage to be initially applied across the lower lamp 4 during starting, since the secondary voltage magnitude is typically insufficient to start both lamps simultaneously. When lamp 4 has started, the voltage drop across it is low so that the secondary voltage then becomes sufficient to start lamp 2. The open circuit AC voltage waveform appearing across the leads 24, 26 of the conventional ballast circuit of FIG. 1 is illustrated at 44 in FIG. 4.

Figure 2:
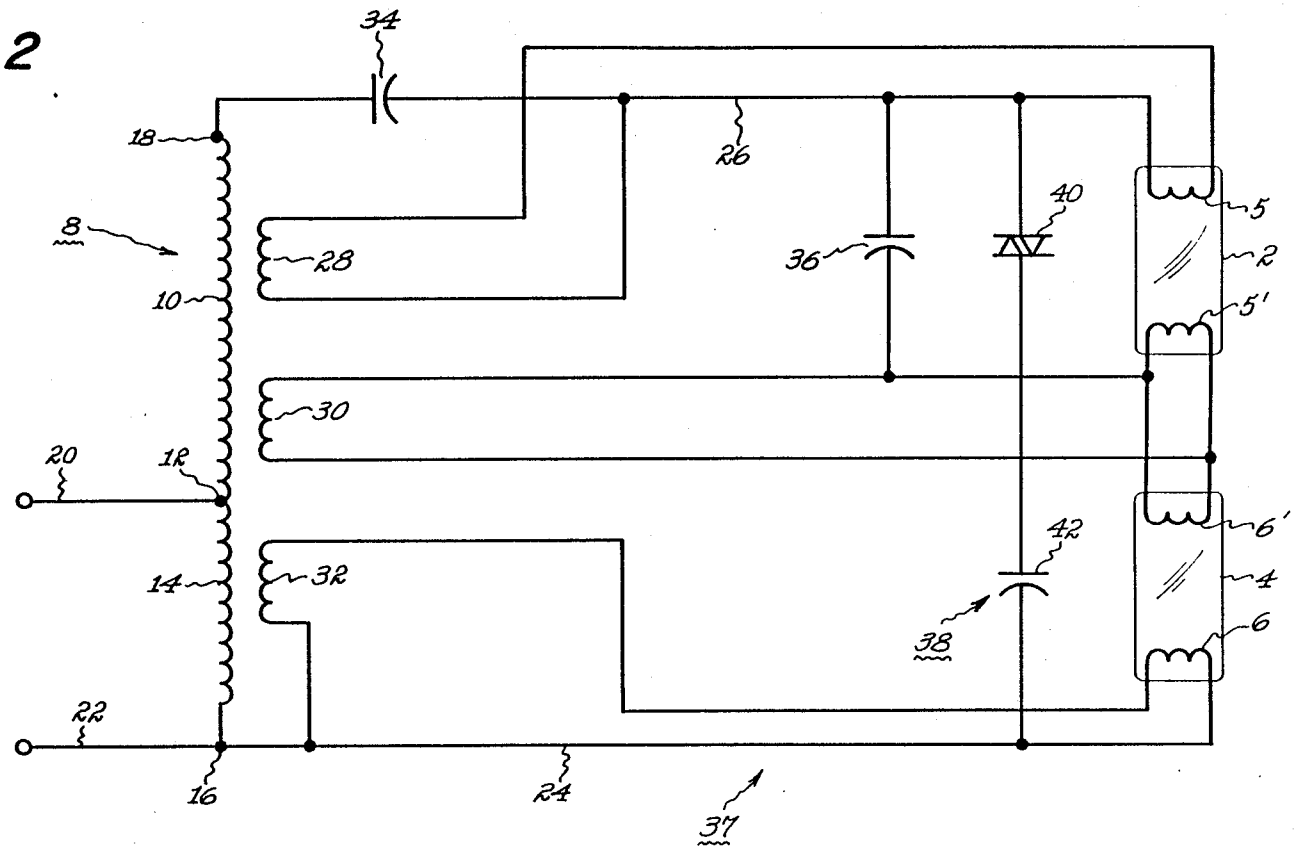
FIG. 2 is a schematic diagram of an improved ballast circuit constructed in accordance with an embodiment of the present invention.

The improved ballast circuit of the present invention is shown in FIG. 2 and is generally indicated at 37. Ballast circuit 37 is schematically the same as the conventional ballast circuit shown in FIG. 1, except that, in accordance with the present invention, it further includes an oscillator circuit, indicated generally at 38. This oscillator circuit is connected across the ballast circuit output leads 24, 26 and operates to generate high frequency oscillations superimposed on the high AC voltage applied across the end cathodes 5, 6 of the serially connected lamps 2, 4.

Oscillator circuit 38 includes an electronic bilateral triggering device 40 and a capacitor 42 connected in series combination across ballast circuit output leads 24, 26. The electronic bilateral triggering device 40 is constituted of one or several series connected transistors having a characteristic breakover voltage value, which, if exceeded, conducts a characteristic breakover current. Device 40 also has a characteristic holding current value several orders of magnitude greater than its characteristic breakover current value, which, if exceeded, triggers the device to a low impedance, high current conducting state. In accordance with the present invention, device 40 is constrained to operate in the current range between its characteristic breakover and holding current values while its breakover voltage is exceeded. To this end, capacitor 42 is selected such as to limit the bilateral triggering device current to a value less than the characteristic holding current. When the breakover voltage of device 40 is exceeded, the internal resistance of device 40 is reduced permitting current to flow. The device resistance can continue to go down and more current can flow, but the current is limited by the capacitor 42. If the current through device 40 is kept below the characteristic holding current value, the device resistance will increase and the current will oscillate between the breakover current value and the value as limited by capacitor 42. The frequency of the oscillations are determined by the inductance of ballasting transformer 8 and the capacitances of capacitors 42 and 34. These current oscillations are effective in generating a burst of high frequency oscillations superimposed on the applied AC voltage wave as long as the device characteristic breakover voltage is exceeded.

One type of electronic bilateral triggering device having the above-described operating characteristics is the so-called "SIDAC" transistor, such as the K1V series of SIDACs available from Shindengen Electric Mfg. Co., Ltd. Comparable bilateral triggering devices are also offered by Motorola Semiconductor Products, Inc.

Figure 5:
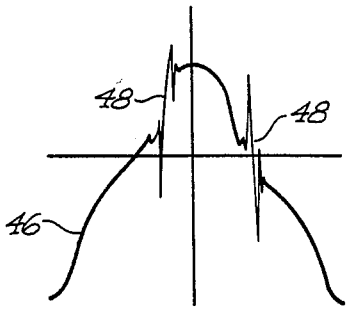
FIG. 5 is a graph of the applied open circuit voltage waveform generated by the improved ballast circuit of the present invention FIGS. 2 and 3.

The graph 46 in FIG. 5 represents the open circuit AC voltage waveform appearing across output leads 24, 26 of the improved ballast circuit 37 shown in FIG. 2. Comparing FIGS. 4 and 5 it is seen that, in the latter, the high frequency oscillations generated by oscillator circuit 38, which may be in the twenty kiloHertz range, are superimposed on the high AC voltage waveform, as indicated at 48, to dramatically improve the capacitive coupling between the lamps and their mounting fixture (not shown). This improved capacitive coupling provides more efficient and reliable rapid-starting of the lamps without resorting to specialized, expensive starting aids such as conductor strips painted on or otherwise affixed to the lamps or a tin oxide coating on the lamp interior.

When fluorescent lamps 2, 4 start in succession, they represent a low impedance path to current, and therefore the voltage drop across device 40 is depressed well under its breakover voltage value. Device 40 will thus be maintained in a nonconductive state while lamps 2, 4 remain lit to effectively remove oscillator circuit 38 from the ballast circuit.

Figure 3:
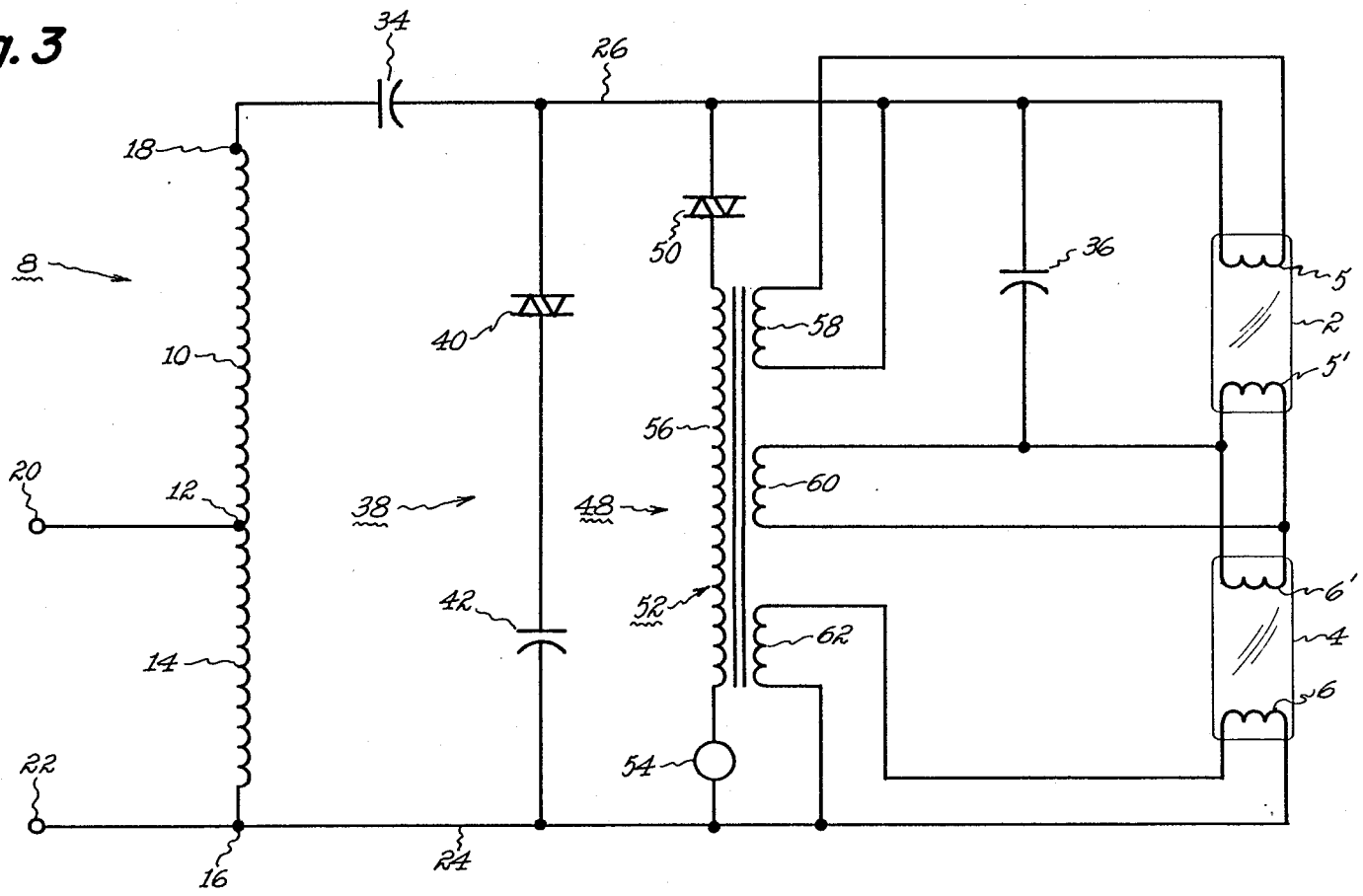
FIG. 3 is a schematic diagram of an improved ballast circuit constructed in accordance with an alternative embodiment of the present invention.

In the embodiment of the present invention shown in FIG. 3 improved lamp cathode heating circuitry, indicated generally at 48, is utilized in combination with the high frequency oscillator circuit 38. Cathode heating circuitry 48 includes a second electronic bilateral triggering device 50, the primary winding 56 of a heating current transformer 52, and a positive temperature coefficient (PTC) resistor 54 all connected in series between output leads 24, 26. Heating current transformer 52 has three secondary windings 58, 60, and 62, with winding 60 connected across the interconnected terminals of cathodes 5', 6' and windings 58, 62 respectively connected across the terminals of end cathodes 5, 6 of the lamps 2, 4 for supplying cathode heating current thereto.

The second triggering device 50, which may be of the same type as device 40, switches to a conducting state when the high AC voltage across output leads 24, 26 exceeds its breakover voltage to conduct primary current to heating current transformer 52 and thus supply heating current to the lamp cathodes 5, 5', 6, 6'. As the lamp cathodes 5, 5', 6, 6' are being heated, the primary current flow through PTC resistor 54 causes its resistance to increase thereby reducing the voltage drop across device 50. When the cathodes are sufficiently heated, the voltage drop across device 50 will have fallen to a level insufficient to sustain conduction. Device 50 then switches to its nonconducting state, and full starting voltage with the high frequency oscillations superimposed thereon by oscillator circuit 38 is then impressed across the lamps. When the lamps 2, 4 are successively lit, the oscillator circuit removes itself from the ballast circuit as described above.

Although the illustrated embodiments are shown in conjunction with a pair lamps, the present invention is equally applicable to starting and powering any number of fluorescent lamps, including a single lamp.

As previously noted, a SIDAC transistor such as the K1V series of SIDACs available from the Shindengen Mfg. Co. may be utilized as electronic bilateral triggering device 40. It may be necessary to connect two or more such SIDACs in series to match the requisite breakover voltage characteristic to a particular fluorescent lamp. For example, assume that a single fluorescent lamp requires a minimum starting voltage of 190 volts and represents a maximum voltage drop of approximately 120 volts while lit. Thus, the electronic bilateral triggering device 40 must reliably breakover at 190 volts at the least and remain off at lamp voltages of 120 volts or less. A K1V6 Shindengen SIDAC has a rated breakover voltage characteristic in the range of 55–65 volts, while a K1V10 Shindengen SIDAC has rated breakover voltage characteristic in the range of 95–113 volts. Thus, connecting these two SIDACs in series yields a combined breakover voltage characteristic in the range of 150–178 volts, which is seen to meet the requisite device 40 operating characteristics. The rated holding current value for these SIDACs is 50 milliamps. Thus, capacitor 42 is selected to limit current flow therethrough to a maximum value less than 50 milliamps. A capacitor in the range of 0.05 to 0.15 microfarads has been determined to afford this requisite current limitation and also to provide the desired, capacitive coupling-enhancing, rapid-start-inducing high frequency oscillations.

It is seen from the foregoing that the present invention provides an improved fluorescent lamp ballast circuit incorporating a high frequency oscillator of emnnently simple construction employing a minimal number of components, as compared to the prior art. The ballast circuit of the present invention is thus less expensive to manufacture and more reliable in operation. Rapid and reliable lamp starting is achieved without the need for starting aids such as conductor strips painted on the lamp exterior or an expensive tin oxide coating on the lamp interior.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

Having described the invention, what is claimed as new and desired to secure by Letters Patent is:

1. An improved rapid-start ballast circuit for a fluorescent lamp having a cathode disposed at each end thereof, said ballast circuit comprising:

a ballasting transformer having a secondary winding for developing a high AC voltage across a pair of output terminals respectively connected to the lamp cathodes; and a high frequency oscillator including an electronic bilateral triggering device and a capacitor connected in series combination across the fluorescent lamp cathodes, said electronic bilateral triggering device and said capacitor generating high frequency oscillations superimposed on the high AC voltage applied across the lamp cathodes thereby to achieve efficient and reliable starting of the lamp, said device becoming non-conductive after the lamp has started.

2. A ballast circuit according to claim 1, wherein said electronic bilateral triggering device has characteristic breakover voltage, breakover current and holding current values, said device switching to a current conducting state in response to a voltage exceeding said breakover voltage value applied thereacross and said capacitor selected to limit the current flowing through said device to a maximum value less than said holding current value, whereby the current flowing through said device oscillates between said breakover current value and said maximum value to generate a burst of high frequency oscillations superimposed on said applied AC voltage wave as long as the voltage across said device exceeds said characteristic breakover voltage, said device switching to a non-conducting state in response to the voltage drop across said device falling below said breakover voltage value after the lamp is started.

3. A ballast circuit according to claim 1, wherein said oscillator consists solely of said device and capacitor series combination.

4. The ballast circuit according to claim 3, wherein the capacitance of said capacitor is in the range of 0.05 to 0.15 microfarads.

5. The ballast circuit according to claim 1, wherein high frequency oscillation bursts are superimposed on both positive and negative half cycles of said applied AC voltage wave.

6. The ballast circuit according to claim 5, wherein said oscillation bursts are generated at a frequency in the range of twenty kiloHertz.

7. A ballast circuit according to claim 2 which further includes means for supplying heating current to the lamp cathodes.

8. A ballast circuit according to claim 7 wherein said means for supplying heating current includes tertiary ballasting transformer windings, each of said tertiary windings having a pair of output terminals respectively connected across each lamp cathode for supplying heating current thereto.

9. A ballasting circuit according to claim 7 wherein said means for supplying heating current includes:

an additional electronic bilateral triggering device having a characteristic breakover voltage value;

a heating current transformer having a primary winding and secondary windings respectively connected with each lamp cathode for supplying heating current thereto; and a positive temperature coefficient resistor;

said primary winding, said additional device and said resistor being connected in series across said secondary winding output terminals of said ballasting transformer;

said additional electronic bilateral triggering device switching to a current conducting state in response to a voltage drop across said device in excess of said breakover voltage value to supply primary current to said heating current transformer primary winding and thus heating current to the lamp cathodes, the primary current flowing through said resistor increasing the resistance thereof, thereby reducing the voltage drop across said additional device while the lamp cathodes are heated, said additional device switching to a non-conducting state in response to the voltage drop thereacross falling below said breakover voltage value.

10. A ballast circuit according to claim 1 wherein a plurality of fluorescent lamps are connected in a string of serially interconnected cathodes with the cathodes at each end of the lamp string respectively connected to said output terminals; said ballast circuit further including a starting capacitor connected in parallel across said cathodes of each lamp except one lamp at an end of the lamp string.

11. A ballast circuit according to claim 10 which further includes means for supplying heating current to the cathodes of the lamps.

12. A ballast circuit according to claim 11 wherein said means for supplying heating current includes tertiary ballasting transformer windings, each of said tertiary windings having a pair of output terminals respectively connected across one of the lamp cathodes of the plurality of lamps for supplying heating current thereto.

13. A ballast circuit according to claim 11 wherein said means for supplying heating current includes:

an additional electronic bilateral triggering device having a characteristic breakover voltage value;

a heating current transformer having a primary winding and secondary windings respectively connected with each lamp cathode of the plurality of lamps for supplying heating current thereto; and a positive temperature coefficient resistor;

said primary winding, said additional triggering device and said resistor being connected in series across said secondary winding output terminals of said ballasting transformer in shunt with said string of serially interconnected lamps;

said additional electronic bilateral triggering device switching to a conducting state in response to a voltage drop across said device in excess of said breakover voltage value to supply primary current to said heating current transformer primary winding and thus heating current to the lamp cathodes, the primary current flowing through said resistor increasing the resistance thereof thereby reducing the voltage drop across said additional device while the lamp cathodes are heated, said additional device switching to a non-conducting state in response to the voltage drop thereacross falling below said breakover voltage value.

14. A ballast circuit according to claim 13 wherein said electronic bilateral triggering device of said oscillator has characteristic breakover voltage, breakover current and holding current values, said device switching to a current conducting state in response to a voltage exceeding said breakover voltage value applied thereacross, and said capacitor selected to limit the current flowing through said device to a maximum value less than said holding current value, whereby the current flowing through said device oscillates between said breakover current value and said maximum value to generate a burst of high frequency oscillations superimposed on the applied AC voltage wave as long as the voltage across said device exceeds said characteristic breakover voltage, said device switching to a non-conducting state in response to the voltage drop across said device falling below said breakover voltage value after the lamps are started.

15. A ballast circuit according to claim 12, wherein said oscillator consists solely of said device and capacitor series combination.

16. The ballast circuit according to claim 13, wherein high frequency oscillation bursts are superimposed on both positive and negative half cycles of said applied AC voltage wave.

* * * * *